US006425611B1

(12) United States Patent
Minter et al.

(10) Patent No.: US 6,425,611 B1
(45) Date of Patent: Jul. 30, 2002

(54) LOCK HANDLE ASSEMBLY FOR CASEMENT WINDOWS

(75) Inventors: Peter J. Minter; John A. Chiaia, both of Branford, CT (US)

(73) Assignee: Roto Frank of America, Inc., Essex, CT (US)

( * ) Notice: Subject to any disclaimer, the term of this patent is extended or adjusted under 35 U.S.C. 154(b) by 0 days.

(21) Appl. No.: 09/493,598

(22) Filed: Jan. 31, 2000

(51) Int. Cl.[7] ..... E05C 3/08

(52) U.S. Cl. ..... 292/336.3; 292/DIG. 33; 74/533; 74/540

(58) Field of Search ..... 292/336.3, DIG. 33; 74/533, 534, 535, 540

(56) References Cited

U.S. PATENT DOCUMENTS

| | | | | | |
|---|---|---|---|---|---|
| 1,803,725 | A | * | 5/1931 | Ottinger | 292/336.3 |
| 4,059,298 | A | * | 11/1977 | Van Klompenburg | 292/199 |
| 4,429,910 | A | * | 2/1984 | Anderson | 292/199 |
| 4,621,847 | A | * | 11/1986 | Paulson et al. | 292/DIG. 33 |
| 4,991,886 | A | | 2/1991 | Nolte et al. | |
| 5,118,145 | A | | 6/1992 | Tucker | |
| 5,318,333 | A | | 6/1994 | Dreifert | |
| 5,370,428 | A | | 12/1994 | Dreifert et al. | |
| D388,689 | S | | 1/1998 | Bauman et al. | |
| D390,445 | S | | 2/1998 | Johnson et al. | |
| 5,741,031 | A | | 4/1998 | Bauman et al. | |
| 5,778,602 | A | * | 7/1998 | Johnson et al. | 49/449 |
| 5,839,767 | A | * | 11/1998 | Piltingsrud | 292/336.3 |
| D440,143 | S | * | 4/2001 | Minter et al. | D8/338 |

OTHER PUBLICATIONS

Brochure entitled: "Casement Operator and Multi Point Locking Bar for Vinyl and Aluminium Casement Windows" by Wilhelm Weidtmann GmbH & Co. KG Baubeschläge.

* cited by examiner

*Primary Examiner*—Anthony Knight
*Assistant Examiner*—Mark Williams
(74) *Attorney, Agent, or Firm*—Marshall, Gerstein & Borun

(57) ABSTRACT

A lock handle assembly for a casement window is provided. The lock handle assembly includes an escutcheon that includes an inner side and an outer side. The escutcheon is securable to the frame inside a cavity with at least a portion of the inner side of the escutcheon being disposed at the inside surface of the frame. The escutcheon also includes an upper wall and a lower wall with an elongated recess disposed therebetween for receiving a handle and defining the limits of rotation of the handle. The handle extends into the recess and is connected to a drive disk. The drive disk is pivotally connected to a fixed gear plate thereby providing a rotational axis for the handle. The fixed gear plate is secured to an inside surface of the frame. The fixed gear plate includes an arcuate gear segment. The drive disk is also connected to a drive gear link which includes a proximal end having an arcuate gear segment enmeshed with the arcuate gear segment of the fixed gear plate and a distal end which is connected to a connecting link at the connecting axis and which is connected to a tie bar. The handle is capable of rotating through an angle ranging from about 100° to about 140° and the connecting axis is capable of moving through an arcuate path defined by an angle ranging from about 140° to about 180°.

18 Claims, 4 Drawing Sheets

LOCK HANDLE ASSEMBLY FOR CASEMENT WINDOWS

FIELD OF THE INVENTION

The present invention relates generally to locking mechanisms for casement windows. More specifically, the present invention relates to an improved lock handle assembly or actuator assembly for a casement window lock. Still more specifically, the present invention relates to an improved lock handle assembly or actuator assembly for installation on wood casement windows.

BACKGROUND OF THE INVENTION

Casement windows are known. In the past, the locking of a casement window sash to a window frame has been problematic because casement window sashes have a tendency to warp with age and therefore it can be difficult to hold an entire side edge of a sash against a frame for locking purposes. Further, casement window operators typically apply the closing force to only one end of the casement window sash, e.g. the bottom end, and therefore there is a tendency for one end of the sash to engage the frame before the opposing end of the sash. As a result, the side edge of the sash that is to be locked against the frame does not engage the frame all at once thereby making the sash difficult to lock.

To overcome these problems, tie bars have been employed along the edge of the frame to lock the sash against the frame. The tie bars typically include a plurality of rollers mounted on the tie bar that engage ramped keepers spaced along the edge of the window sash. To overcome the warping problem discussed above, the rollers and keepers are appropriately spaced so that the rollers engage the keepers in a sequential manner, starting from the bottom of the sash and ending with the top of the sash. As a result, the bottom of the sash is locked first and the sequential interaction of the middle and top rollers with the middle and top keepers respectively results in the middle and top portions of the sash being pulled against the frame and locked shut.

However, due to the success and wide acceptance of such sequential locking mechanisms, these locking mechanisms are used in a variety of different windows having window frames and window sashes with a variety of dimensions and configurations. As a result, the spacing between the handle or actuator from the tie bar can vary depending upon the manufacturer and window style. Some locks are usable only with certain styles of windows and other window styles require that locks be specifically manufactured for that style. As a result, manufacturing costs can be quite high and the wide variety of locks that are required requires builders to maintain undesirably large inventories of such locks.

A further problem associated with casement window locks employing tie bars is the relative ease in which such locks can be picked. Specifically, in many prior art casement window locks, an intruder can pick the lock or force the lock open by sticking a sharp object between the sash and the frame, engaging the tie bar and pushing downward. Many casement window locks will easily open up upon the application of downward pressure on the tie bar because the handles for casement window locks are not held or retained in place and are typically free to move from the locked to the open position. Further, any attempt to employ a retainer or a latch to hold the handle in the closed or locked position would adversely affect the aesthetics of the handle and escutcheon assembly.

Still further, aesthetic demands have required the handle and escutcheon to have a relatively low profile on the inside surface of the frame. Escutcheons that protrude outwardly from the inside surface of the frame more than ¾" are not preferred by consumers and interior designers because they present a prominent appearance on the inside surface of the frame. Instead, consumers and interior designers prefer a low profile escutcheon/handle combination that attracts little notice.

However, while aesthetics demand a low profile, functionality often demands that the handle be able to rotate 180° in order to impart a sufficient amount of linear travel to the tie bar. As a result, currently available lock handle assemblies are not able to provide a combination of a low profile for the handle and escutcheon in combination with a 180° rotation of the handle.

Therefore, there is a need for an improved lock handle assembly for casement windows that can be utilized on a variety of window designs, that is relatively pick proof or "jimmy" proof and further that provides a combination of a low profile for the escutcheon and handle with a sufficient amount of lever throw resulting in a sufficient amount of linear travel for the tie bar.

Still further, the entire locking mechanism including the lock handle assembly is often installed in a wooden window frame prior to shipment of the window to a construction site. As a result of this pre-installation, the handles of the lock handle assemblies are prone to breakage during shipment and handling. Accordingly, there is a need for an improved lock handle assembly for casement windows with a detachable handle which can be detached from the assembly during shipment and easily re-attached at the construction site.

SUMMARY OF THE INVENTION

The present invention provides an improved lock handle assembly for casement windows that satisfies all of the aforenoted needs. Specifically, the lock handle assembly of the present invention can be used with a wide variety of different casement window frames due to its use of a connecting link between the tie bar and the lock handle mechanism. Further, the inventive drive gear link of the present invention provides a "over center" condition relative to the central point of rotation which makes the lock handle assembly of the present invention especially difficult to pick or jimmy. Still further, the lock handle assembly of the present invention includes an escutcheon that has a low profile with respect to the inside surface of the window sash but still permits the handle to rotate through an arc sufficiently large enough to enable the axis, where the connecting link is pivotally connected to the drive gear link, to rotate through an arc sufficiently large enough to impart a linear travel to the tie bar in excess of 1.50". Finally, to facilitate painting of the window frame, the handle is only detachably connected to the assembly and can be removed during painting.

In an embodiment, the present invention provides a lock handle assembly for a casement window that has a movable sash received in a frame. The frame includes a cavity as well as an inside surface. The lock handle assembly comprises an escutcheon which comprises an inner side and an outer side. The escutcheon is securable to the frame inside the cavity with at least a portion of the inner side of the escutcheon being disposed at the inside surface of the frame. The escutcheon further comprises an upper wall and a lower wall with an elongated recess disposed therebetween for receiving a handle. The handle extends into the recess and comprises one end connected to a drive disk. The drive disk is pivotally connected to a fixed gear plate at a rotational axis.

The fixed gear plate is connected to the frame, inside the cavity opposite the escutcheon. The fixed gear plate comprises an arcuate gear segment. The drive disk is also connected to the drive gear link. The drive gear link comprises a proximal end and a distal end. The proximal end of the drive gear link comprises an arcuate gear segment in mesh with the arcuate gear segment of the fixed gear plate. The distal end of the drive link is connected to a connecting link at a connecting axis. The upper and lower walls of the escutcheon define a range of rotation for the handle that extends through an angle ranging from about 100° to about 140°. Further, the connecting axis, where the connecting link is connected to the drive gear link, moves through an arcuate path extending through an angle ranging from about 140° to about 180°.

In an embodiment, the upper and lower walls extend towards each other as they extend from the inner side towards the outer side of the escutcheon.

In an embodiment, the angle through which range of rotation of the handle extends ranges from about 110° to about 130°.

In an embodiment, the angle through which range of rotation of the handle extends is about 120°.

In an embodiment, the angle through which the arcuate path of the connecting axis extends ranges from about 150° to about 170°.

In an embodiment, the angle through which the arcuate path of the connecting axis extends is about 160°.

In an embodiment, the handle is detachably connected to the drive disk.

In an embodiment, the one end of the handle that is connected to the drive disk comprises at least one prong and the drive disk comprises at least one recess for frictionally receiving the prong of the handle thereby detachably connecting the handle to the drive disk.

In an embodiment, the drive disk comprises a protruding member that extends outward from the rotational axis, the protruding member being connected to the drive gear link.

In an embodiment, the one end of the handle that is connected to the drive disk is forked and comprises two spaced apart prongs, the drive disk comprises two recesses disposed on opposite sides of the rotational axis, each recess for frictionally receiving one of said prongs thereby detachably connecting the handle to the drive disk.

In a preferred embodiment, the linear travel imparted to the tie bar exceeds 1.50" and, in a preferred embodiment, is about 1.89" or greater. Manipulation of the gear segments, i.e. the gear segment of the fixed gear plate where the gear segment of the drive gear link, can either increase or decrease the linear travel available. In any event, a sufficient linear travel to the tie bar is provided by the present invention so as to make the handle assembly of the present invention suitable for sequential locking systems with two, three or four roller/keeper pairs.

In a preferred embodiment, the drive disk is connected to the distal end of the drive gear link at a point that is offset from the connecting axis, or where the distal end of the drive gear link is connected to the connecting link. This offset relationship creates a "over center" condition which makes the lock handle assembly of the present invention pick or jimmy resistant. Specifically, if a downward force is exerted on the connecting link or tie bar when the lock handle assembly of the present invention is in a locked position, the downward force exerted by the connecting link and the distal end of the drive gear link will bias the distal end of the drive gear link towards the escutcheon or towards the inside surface of the window frame. In contrast, this same force also biases the proximate end of the drive gear link away from the inside surface of the window frame towards the exterior of the window. This action is opposite to the action required to open the lock and simply jams the lock in the closed or locked position. As a result, a downward force exerted on the tie bar or the connecting link when the lock handle assembly of the present invention is in the locked position simply jams the lock handle assembly in the locked position and therefore renders the lock handle assembly of the present invention tamper or jimmy resistant.

Further, as noted above, the handle is detachable thereby facilitating any painting operation after the assembly is installed and the handle can be removed for shipment and handling.

Other objects and advantages of the present invention will become apparent to those skilled in the art upon reviewing the following detailed description, drawings and appended claims.

BRIEF DESCRIPTION OF THE DRAWINGS

For a more complete understanding of the present invention, reference should now be made to the embodiments illustrated in greater detail in the accompanying drawings and described below by way of examples of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
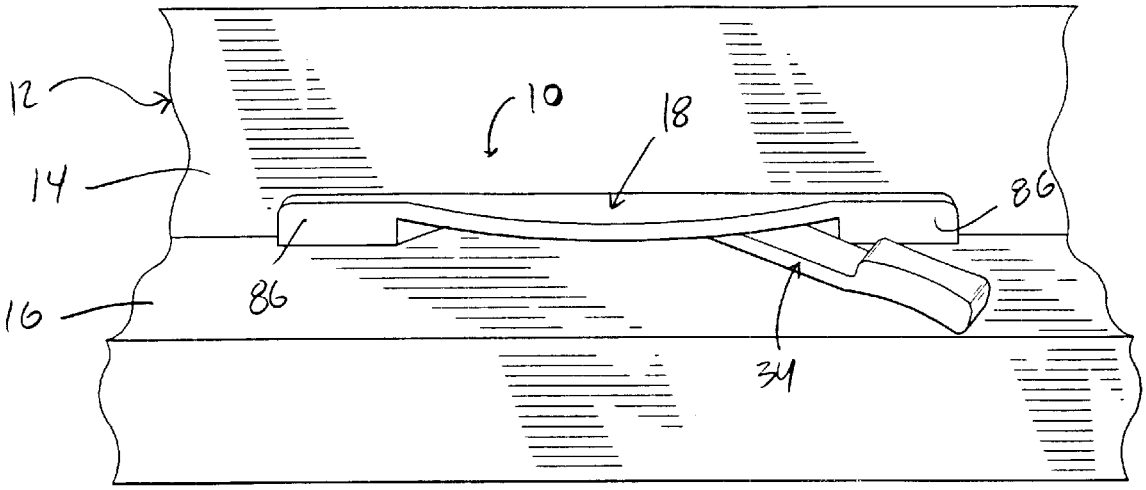
FIG. 1 is a perspective view of a lock handle assembly made in accordance with the present invention as installed in a window frame between the jamb and the woodstop.

Turning first to FIG. 1, a lock handle assembly 10 is shown as installed in a window frame 12 between the woodstop 14 and jamb 16. Specifically, a recess or cavity is cut into the woodstop 14 thereby permitting insertion of the escutcheon 18 and other components of the assembly 10 between the woodstop 14 and jamb 16.

Figure 2:
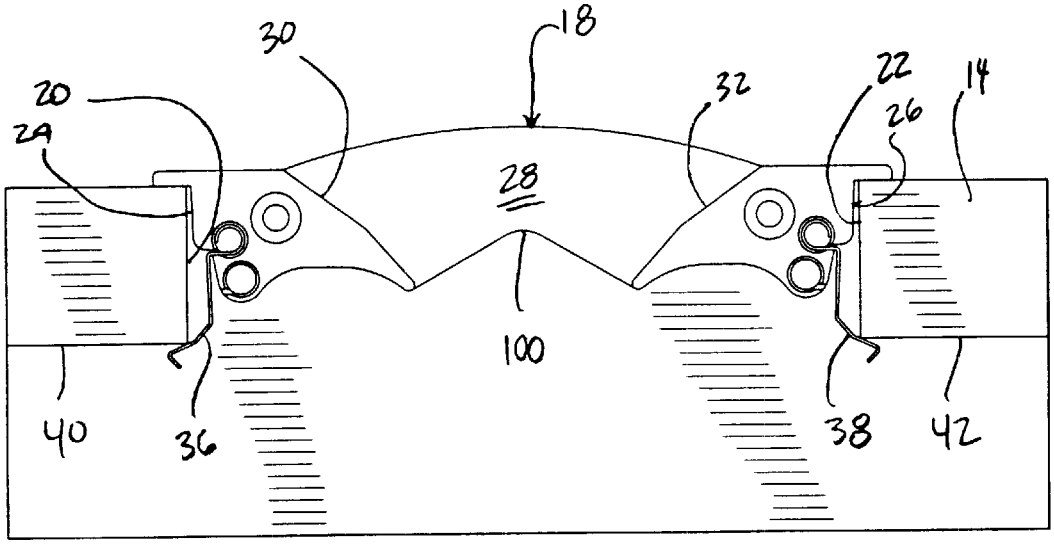
FIG. 2 is a side plan view of the escutcheon of the lock handle assembly shown in FIG. 1 as installed in a recess disposed in the woodstop between the woodstop and jamb.

Turning to FIG. 2, it can be seen that a recess or cavity has been cut into the woodstop 14 thereby providing two opposing walls 20, 22 which are slightly spaced from the ends 24, 26 respectively of the escutcheon 18.

The escutcheon 18 provides a recess 28 disposed between upper and lower walls 30, 32 respectively which limit the movement of the handle 34 (see FIG. 1). Further, springs 36, 38 are employed to hold the escutcheon 18 in place in the woodstop 14. However, other frictional means for securing the escutcheon 18 in place will be apparent to those skilled in the art such as ridges or ribs disposed on the walls 24, 26 of the escutcheon 18 or clips that do not engage the walls 20, 22 of the woodstop 14 but rather hook onto and engage the rear walls 40, 42 of the woodstop 14.

Figure 3:
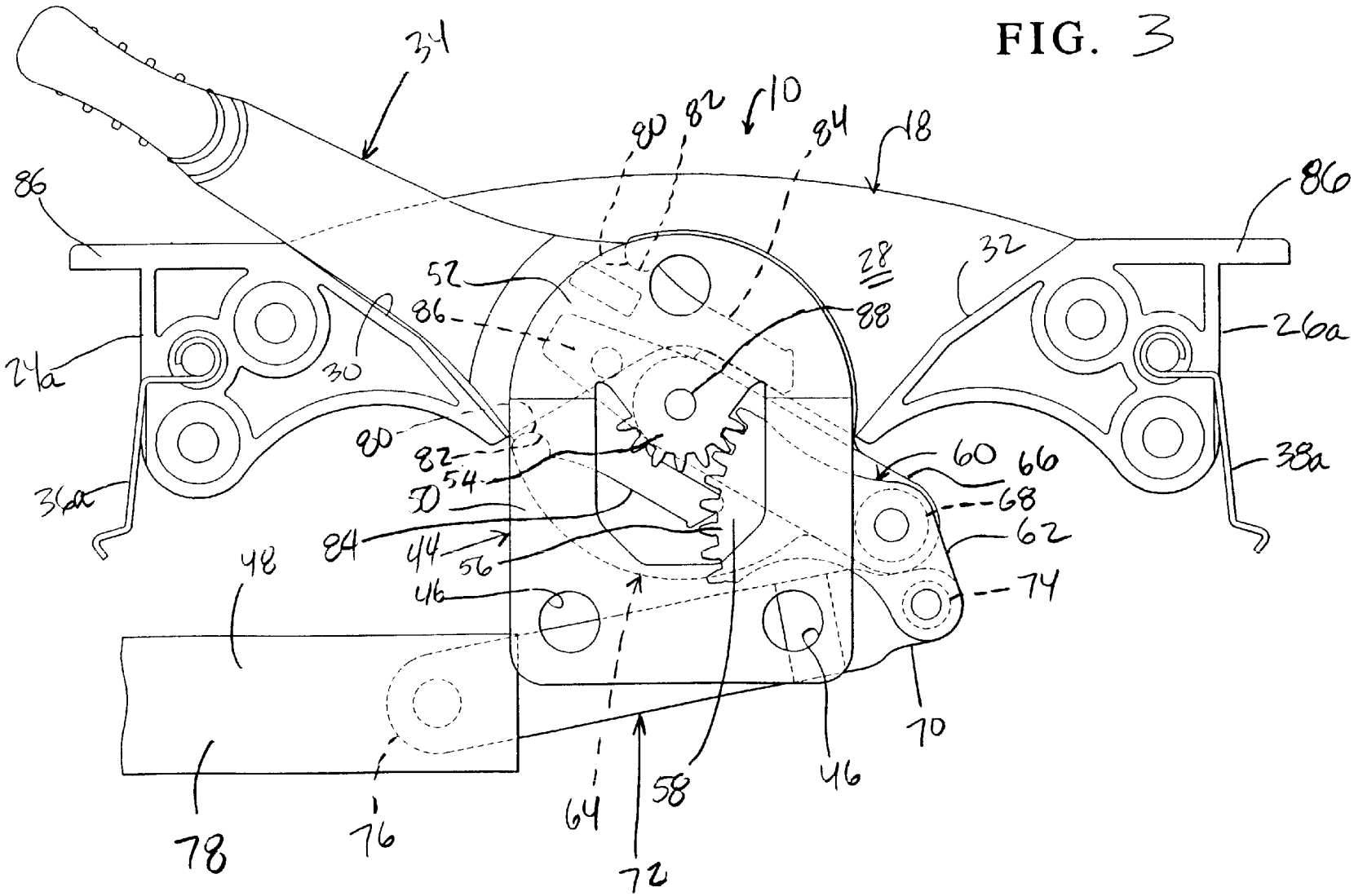
FIG. 3 is a side plan view of the lock handle assembly of the present invention in the open or unlocked position.
Figures 4, 6:
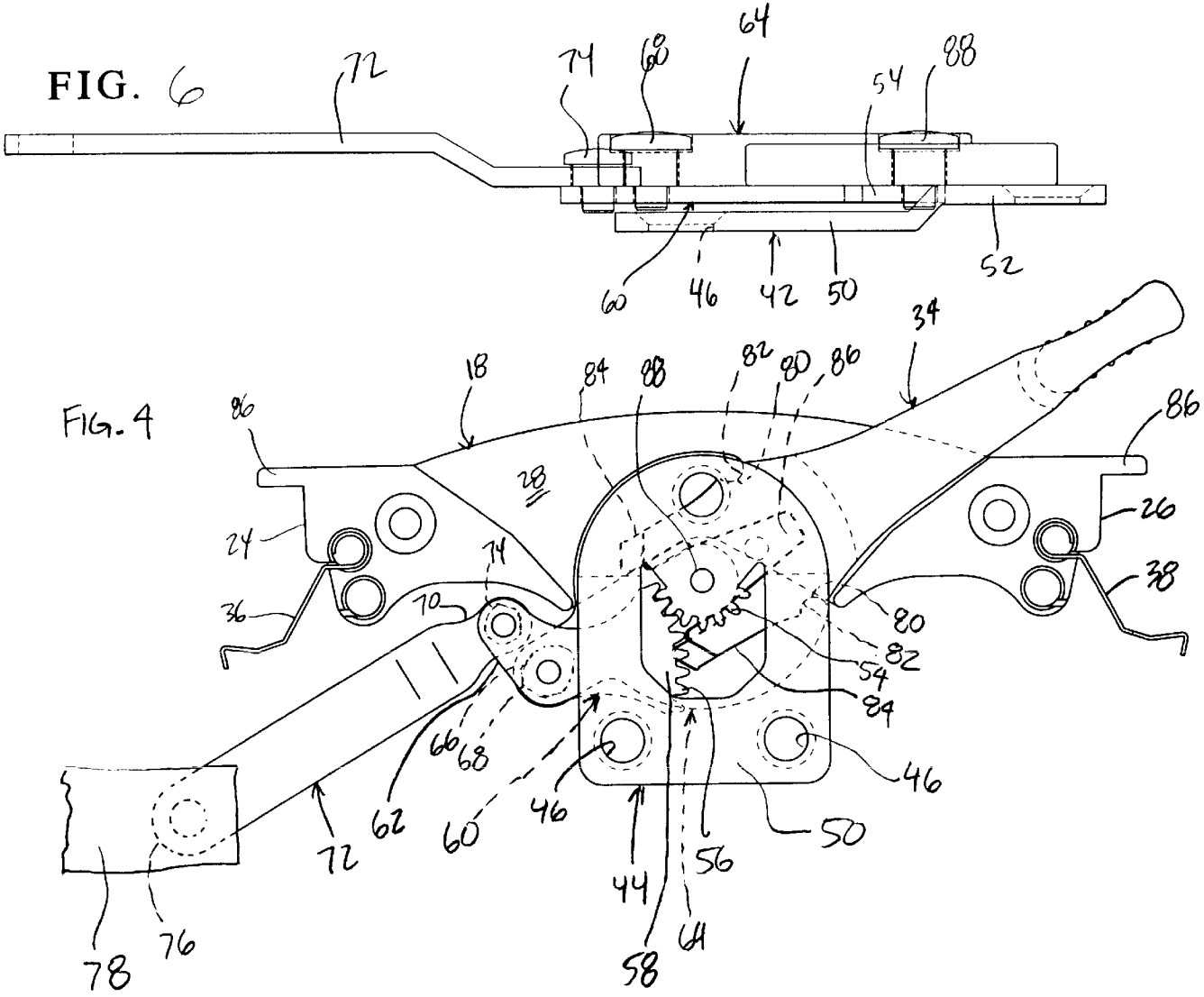
FIG. 4 is a side plan view of the lock handle assembly of the present invention in the closed or locked position.
FIG. 6 is a side view of the lock handle assembly of the present invention as shown in FIG. 5 without the handle or escutcheon.

Turning to FIG. 3, while it will be noted that the escutcheon 18 is secured to the woodstop 14, the fixed gear plate 44 is connected to the jamb 16 by way of flathead screws or other suitable fastening devices that extend through the holes 46. Similarly, the tie bar 48 is also secured to the jamb in a manner well known to those skilled in the art. As shown in FIG. 6, the fixed gear plate 44 includes a bottom section 50 that lies flat against the jamb 16 and a top section 52 that extends outward into the recess 28 of the escutcheon 18. Extending downward from the top section 52 is an arcuate gear sector 54. The arcuate gear sector 54 engages the arcuate gear sector 56 disposed at the proximal end 58 of the drive gear link 60. The drive gear link 60 includes a distal end 62 which is connected to a drive disk shown in phantom at 64 due to the placement of the drive disk 64 between the fixed gear plate 44 and the escutcheon 18. In the embodiment shown in FIG. 3, the drive disk 64 includes a protruding member 66 which is connected to the distal end 62 of the drive gear link 60 by way of a rivet 68. Further, the distal end 62 of the drive gear link 60 is also connected to the proximate end 70 of the connecting link 72 by way of a rivet 74 that serves as a "connecting axis". The distal end 76 of the connecting link 72 is connected to a tie bar 78.

The drive disk 64 is also detachably connected to the handle 34 by way of the protruding members 80 which are received within the detents 82 of the prongs 84 of the handle 34. Further, a slot-in-groove connection is provided between the prongs 84 of the handle 34 and the central member 86 of the drive disk 64. Thus, the handle 34 is detachably connected to the assembly 10 that can be removed for painting or for shipment and handling.

Movement of the assembly 10 from the open position shown in FIG. 3 to the closed or locked position shown in FIG. 4 results in rotation of the arcuate gear sector 58 of the drive gear link 60 around the arcuate gear sector 54 of the fixed gear plate 44. This rotation also results in rotation of the connecting axis or rivet 74 from the position shown in FIG. 3 to the position shown in FIG. 4. The arcuate path through which the connecting axis 74 travels is at least 140° and can range from 140° to 180°. In a preferred embodiment, the arcuate path traveled by the connecting axis or rivet 74 is about 160° which results in linear movement of the tie bar of greater than 1.5" and ranging from 1.5" to 2.0". In a preferred embodiment with four roller/keeper pairs, the linear movement imparted to the tie bar 78 is about 1.89" or greater.

Further, because the connection of the connecting link 72 to the drive gear link 60 (see the rivet 74) is offset from the connection between the drive gear link 60 to the drive disk 64, the lock handle assembly 10 of the present invention is pick or jimmy resistant. Specifically, when an intruder applies a downward force to the tie bar 78 or the connecting link 72, which is to the right as shown in FIG. 4, the downward movement will bias the distal end 62 of the drive link 60 towards the escutcheon thereby further clamping the lock handle assembly 10 in the locked or closed position shown in FIG. 4. Simply put, when the lock handle assembly 10 is in the locked or closed position as shown in FIG. 4, downward pressure on the tie bar 78 or connecting link 72 simply jams the lock handle assembly 10 in the locked position as shown in FIG. 4.

The lock handle assembly 10 has a low profile as shown in FIGS. 3 and 4. The escutcheon 18 includes two oppositely directed walls 86 that rest flat against the surface of the woodstop 12. Thus, only a portion of the handle 34 extends above the surface of the woodstop 12 and the point of rotation for the handle which is the rivet connection 88 between the fixed gear plate 44 and the drive disk 64 (see FIGS. 3 and 4), is disposed well below the surface of the woodstop 12. Thus, the present invention satisfies the aesthetic need for a low profile lock handle assembly that does not protrude prominently outward from the window frame.

Also shown in FIG. 3 is another embodiment of the springs 36*a*, 38*a* and ends 24*a*, 26*a* of the escutcheon 18. The ends 24*a*, 26*a* and springs 36*a*, 38*a* are shaped to frictionally engage the opposing walls 20, 22 of the recess or cavity (see FIG. 2).

Figure 5:
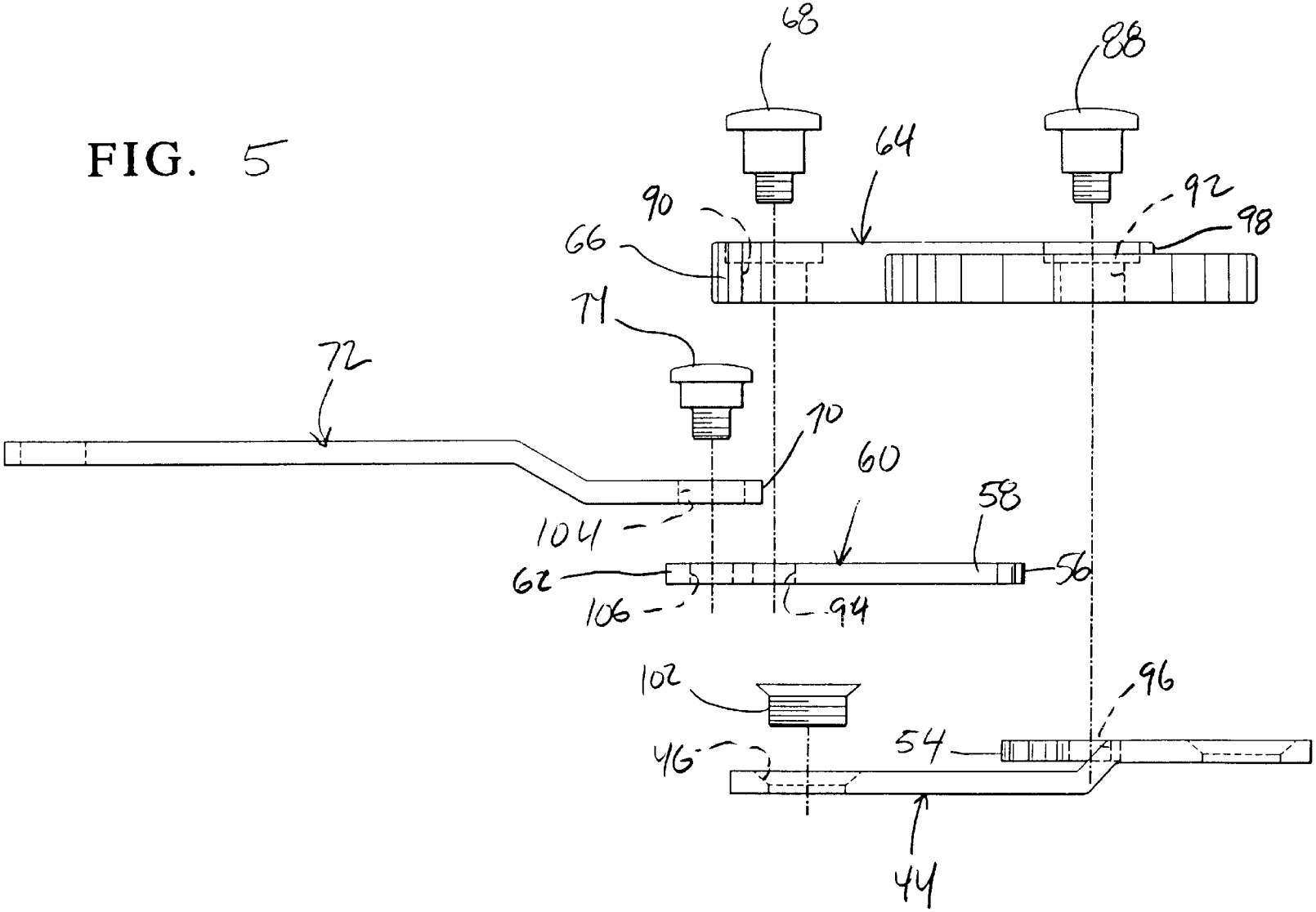
FIG. 5 is an exploded view of the lock handle assembly of the present invention not showing the handle or escutcheon.

As shown in FIG. 5, the drive disk 64 includes recessed holes 90, 92 for accommodating the rivets 68, 88 respectively which attach the drive disk 64 to the drive gear link 60 and fixed gear plate 44 respectively. The drive gear link 60 includes a hole 94 for receiving the rivet 68 and the fixed gear plate 44 includes a hole 96 for receiving the rivet 88. The protruding member 66 of the drive disk 64 includes a ledge 98 which engages the recess 100 disposed in the underside of the escutcheon 18 (see FIG. 2). Flathead screws such as the one shown at 102 can be used to fasten the fixed gear plate 44 to the jamb 16. The rivet 74 passes through the hole 104 disposed in the proximate end 70 of the connecting link 72 before passing through the hole 106 disposed in the distal end 62 of the drive gear link 60 to connect the connecting link 72 to the drive gear link 60.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A lock handle assembly for a casement window having a movable sash received in a frame, the frame including a cavity and an inside surface, the lock handle assembly comprising:

an escutcheon comprising an inner side and an outer side, the escutcheon being securable to the frame inside the cavity with at least a portion of the inner side of the escutcheon being disposed at the inside surface of the frame, the escutcheon comprising an upper wall and a lower wall with an elongated recess disposed therebetween for receiving a handle, the handle extending into the recess and comprising one end detachably connected to a drive disk, the drive disk being pivotally connected to a fixed gear plate at a rotational axis, the fixed gear plate being fixedly connected to the frame, the fixed gear plate comprising an arcuate gear segment, the drive disk further being connected to a drive gear link, the drive gear link comprising a proximal end and a distal end, the proximal end of the drive gear link comprising an arcuate gear segment in mesh with the arcuate gear segment of the fixed gear plate, the distal end of the drive gear link being connected to a connecting link at a connecting axis and the drive disk.

2. The handle assembly of claim 1 wherein the upper and lower walls extend towards each other as they extend from the inner side towards the outer side of the escutcheon.

3. The handle assembly of claim 1 wherein the angle through which range of rotation of the handle extends ranges from about 110° to about 130°.

4. The handle assembly of claim 1 wherein the angle through which range of rotation of the handle extends is about 120°.

5. The handle assembly of claim 1 wherein the angle through which the arcuate path of the connecting axis extends ranges from about 150° to about 170°.

6. The handle assembly of claim 1 wherein the angle through which the arcuate path of the connecting axis extends is about 160°.

7. The handle assembly of claim 1 wherein the one end of the handle that is connected to the drive disk comprises at least one prong and the drive disk comprises at least one recess for frictionally receiving the prong of the handle thereby detachably connecting the handle to the drive disk.

8. The handle assembly of claim 1 wherein the drive disk comprises a protruding member that extends outward from the rotational axis, the protruding member being connected to the drive gear link.

9. The handle assembly of claim 1 wherein the one end of the handle that is connected to the drive disk is forked and comprises two spaced apart prongs, the drive disk comprises two recesses disposed on opposite sides of the rotational axis, each recess for frictionally receiving one of said prongs thereby detachably connecting the handle to the drive disk.

10. The handle assembly of claim 1 wherein the upper and lower walls of the escutcheon defining a range of rotation of the handle extending through an angle ranging from about 100° to about 140°, the connecting axis moving through an arcuate path extending through an angle ranging from about 140° to about 180°.

11. A lock handle assembly for a casement window having a movable sash received in a frame, the frame including a cavity and an inside surface, the lock handle assembly comprising:

an escutcheon comprising an inner side and an outer side, the escutcheon being securable to the frame inside the cavity with at least a portion of the inner side of the escutcheon being disposed at the inside surface of the frame, the escutcheon comprising an upper wall and a lower wall with an elongated recess disposed therebetween for receiving a handle, the handle extending into the recess and comprising one end connected to a drive disk, the drive disk being pivotally connected to a fixed gear plate at a rotational axis, the fixed gear plate being fixedly connected to the frame, the fixed gear plate comprising an arcuate gear segment, the drive disk further being connected to a drive gear link, the drive gear link comprising a proximal end and a distal end, the proximal end of the drive gear link comprising an arcuate gear segment in mesh with the arcuate gear segment of the fixed gear plate, the distal end of the drive gear link being connected to a connecting link at a connecting axis and the drive disk, the drive disk being connected to the distal end of the drive gear link at a point offset from the connecting axis.

12. The handle assembly of claim 11 wherein the handle is detachably connected to the drive disk.

13. The handle assembly of claim 11 wherein the upper and lower walls of the escutcheon defining a range of rotation of the handle extending through an angle ranging from about 100° to about 140°, the connecting axis moving through an arcuate path extending through an angle ranging from about 140° to about 180°.

14. A lock handle assembly for a casement window having a movable sash received in a frame, the frame including a cavity and an inside surface, the lock handle assembly comprising:

an escutcheon comprising an inner side and an outer side, the escutcheon being securable to the frame inside the cavity with at least a portion of the inner side of the escutcheon being disposed at the inside surface of the frame, the escutcheon comprising an upper wall and an outer wall with an elongated recess disposed therebetween for receiving a handle, the upper and lower walls extending towards each other as they extend from the inner side towards the outer side of the escutcheon, the handle extending into the recess and comprising one end detachably connected to a drive disk, the drive disk being pivotally connected to a fixed gear plate at a rotational axis, the fixed gear plate being fixedly connected to the frame inside the recess and opposite the escutcheon, the fixed gear plate comprising an arcuate gear segment, the drive disk further being connected to a drive gear link, the drive gear link comprising a proximal end and a distal end, the proximal end of the drive gear link comprising an arcuate gear segment in mesh with the arcuate gear segment of the fixed gear plate, the distal end of the drive gear link being connected to a connecting link at a connecting axis and the drive disk at a point offset from the connecting axis, the upper and lower walls of the escutcheon defining a range of rotation of the handle extending through an angle ranging from about 110° to about 130°, the connecting axis moving through an arcuate path extending through an angle ranging from about 150° to about 170°.

15. The handle assembly of claim 14 wherein the angle through which range of rotation of the handle extends is about 120°.

16. The handle assembly of claim 14 wherein the angle through which the arcuate path of the connecting axis extends is about 160°.

17. The handle assembly of claim 14 wherein the drive disk comprises a protruding member that extends outward from the rotational axis, the protruding member being connected to the drive gear link.

18. The handle assembly of claim 14 wherein the one end of the handle that is connected to the drive disk is forked and comprises two spaced apart prongs, the drive disk comprises two recesses disposed on opposite sides of the rotational axis, each recess for frictionally receiving one of said prongs thereby detachably connecting the handle to the drive disk.

* * * * *